US011085451B2

(12) United States Patent
Lee et al.

(10) Patent No.: US 11,085,451 B2
(45) Date of Patent: Aug. 10, 2021

(54) HIGH VISCOSITY PUMPING SYSTEM AND METHOD OF USING SAME

(71) Applicant: Alkhorayef Petroleum Company Limited, Al Khobar (SA)

(72) Inventors: Woon Yung Lee, Sugar Land, TX (US); Ying Xue, Shanghai (CN); Yun Cai, Shanghai (CN)

(73) Assignee: ALKHORAYEF PETROLEUM COMPANY LIMITED, Al Khobar (SA)

( * ) Notice: Subject to any disclaimer, the term of this patent is extended or adjusted under 35 U.S.C. 154(b) by 120 days.

(21) Appl. No.: 16/380,364

(22) Filed: Apr. 10, 2019

(65) Prior Publication Data

US 2020/0325901 A1 Oct. 15, 2020

(51) Int. Cl.

| | |
|---|---|
| ***F04D 13/08*** | (2006.01) |
| ***F04D 13/10*** | (2006.01) |
| ***F04D 1/08*** | (2006.01) |
| ***F04D 7/04*** | (2006.01) |
| ***F04D 29/041*** | (2006.01) |
| ***F04D 29/44*** | (2006.01) |
| ***F04D 29/42*** | (2006.01) |

(52) U.S. Cl.

CPC ..... *F04D 13/086* (2013.01); *F04D 1/08* (2013.01); *F04D 7/04* (2013.01); *F04D 13/10* (2013.01); *F04D 29/0413* (2013.01); *F04D 29/426* (2013.01); *F04D 29/445* (2013.01)

(58) Field of Classification Search

CPC ..... F04D 13/086; F04D 13/08; F04D 7/04; F04D 1/08; F04D 13/10; F04D 1/06; F04D 29/0413; F04D 29/406; F04D 29/42; F04D 29/426; F04D 29/44; F04D 29/445

See application file for complete search history.

(56) References Cited

U.S. PATENT DOCUMENTS

| | | | | |
|---|---|---|---|---|
| 5,160,240 | A | 11/1992 | Wilson | |
| 7,575,413 | B2 | 8/2009 | Semple et al. | |
| RE43,363 | E | 5/2012 | Semple et al. | |
| 8,801,360 | B2 * | 8/2014 | Sheth | F04D 29/2266 415/1 |
| 9,638,207 | B2 * | 5/2017 | Jayaram | F04D 13/08 |
| 9,719,523 | B2 * | 8/2017 | Jayaram | F04D 1/00 |
| 2009/0285678 | A1 | 11/2009 | Brunner et al. | |
| 2014/0030055 | A1 * | 1/2014 | Jayaram | F04D 31/00 415/1 |
| 2017/0167498 | A1 * | 6/2017 | Chang | F04D 1/063 |

* cited by examiner

*Primary Examiner* — Bryan M Lettman
(74) *Attorney, Agent, or Firm* — Jones Day

(57) ABSTRACT

An electrical submersible pump (ESP) for use in a high viscosity pumping system includes a pump shaft, at least one rotating impeller including an impeller hub and one or more impeller vanes projecting from the impeller hub. Each of the one or more impeller vanes includes an impeller vane edge, and at least one stationary diffuser positioned below the at least one rotating impeller. A diffuser includes a diffuser hub and a diffuser shroud including a diffuser shroud surface. The impeller vane edge and the diffuser shroud surface are separated only by a clearance gap.

19 Claims, 11 Drawing Sheets

HIGH VISCOSITY PUMPING SYSTEM AND METHOD OF USING SAME

BACKGROUND

1. Field

The following description relates to open impeller multi-stage electrical submersible pumps with improved pumping methods for high viscosity fluids.

2. Description of Related Art

With the discovery of hard retrievable crude oil, highly viscous crude oil has become an important subject in the petroleum industry. Challenges to produce highly viscous crude oil efficiently have existed for many decades. With high viscosity fluid, the power requirements of a pump increases proportionally to the viscosity of the fluid. At the same time, the pump head and production flow rate decrease in an inversely proportional manner to the viscosity of the fluid. Viscosity of crude oil can be in the range of 1 centi-Poise (cP) to 1000 cP. Viscosity of water is approximately 1 cP. If the viscosity of crude oil is 1000 cP, crude oil is hardly moved by a conventional centrifugal pump.

Referring to FIG. 1, a conventional Electrical Submersible Pump (ESP) 10 is illustrated. The conventional ESP 10 includes a pump base 12, a housing 14, a pump discharge head 16, and a shaft 18. The pump base 12 is at the lower end of the pump assembly 10, and the discharge head 16 is at the upper end of the pump assembly 10. The production flow comes from the base 12 at the lower end and is expelled through the discharge head 16 at the upper end. In between the base 12 and the discharge head 16, a number of pumping stages are typically installed along the shaft 18; the number of pumping stages are illustrated only as an example though any number of pumping stages are typically used. A shaft bearing 20 may be mounted to help the pump shaft 18 to rotate stably. A key stop 22 and a compression tube 24 are other components of the conventional pump assembly 10.

The pumping stages of the conventional ESP 10 each typically include an impeller 26, a dynamic rotating part, and a diffuser 28, a static non-rotating part. A spacer 30 may be positioned between the diffuser 28 and the pump shaft 18. Each impeller 26 is located between two diffusers 28. Impellers 26 rotate with the pump shaft 18 which is connected to a motor (not shown).

Referring to FIG. 2A, every impeller 26 is typically constructed of three sections, an impeller hub 26*a*, an impeller vane 26*b*, and an impeller shroud 26*c*. The impeller hub 26*a* is the upper cover of the impeller 26 and connected directly to the shaft 18. The impeller shroud 26*c* is the lower cover of the impeller 26. The impeller vane 26*b* is the connecting structure between the impeller hub 26*a* and the impeller shroud 26*c*, and guides the flow of fluid through the space between the impeller hub 26*a* and the impeller shroud 26*c*. Based on the suction force created through these pumping stages, fluid is transferred from one stage to the next.

Each impeller 26 has at least one support, such as a down-thrust washer 32, at the bottom of the impeller shroud 26*c*. The contact surface is typically covered by a canvas reinforced phenolic laminate, and may function as a sealing surface of recirculation flow between the outlet of the impeller 26 and the inlet of the impeller 26. In addition, the impeller may have a second support, such as an up thrust washer 32, positioned above the impeller hub 26*a*. The phenolic laminate can be worn out fast if the pumping fluid contains abrasive materials.

Referring to FIG. 2B, another example of the impeller 26 includes an extra support, or down thrust washer 32, at the inner center of the impeller hub 26*a* of impeller 26 in addition to the other down thrust 32 at the bottom of the impeller shroud 26*c*. In this example, the impeller hub 26*a* of the diffuser 28 is extended to the inner surface of the impeller hub 26*a* and makes contact therewith. The contact point may be covered with the canvas reinforced phenolic laminate as a bearing material.

Referring now to FIGS. 3A and 3B, when pumping viscous fluid using the conventional ESP as described in reference with FIGS. 1, 2A, and 2B, a thick boundary layer 34 will develop along the solid surface of the flow path. That is, four different boundary layer surfaces 34 of impeller 26 are developed while the impeller 26 rotates. Those include a layer 34*a* at the top of the impeller 26, a layer 34*b* at the bottom of the impeller 26, and layers 34*c*, 34*d* at the two inner flow surfaces of the impeller 26. As shown in FIG. 4, the relative velocity of flow stream U is closer to zero as the flow is measured nearer the boundary layer. In other words, the boundary layers 34*a*, 34*b*, 34*c*, 34*d* reduce the free stream area, and the total flowrate U will be decreased. Due to the shear stress of a viscous flow stream U, one of the major contributors to high power consumption is compensation for reduced flow U along the boundary layers.

SUMMARY

This Summary is provided to introduce a selection of concepts in a simplified form that are further described below in the Detailed Description. This Summary is not intended to identify key features or essential features of the claimed subject matter, nor is it intended to set the scope of the claimed subject matter.

In one aspect, an electrical submersible pump (ESP) for use in a high viscosity pumping system includes a pump shaft, at least one rotating impeller including an impeller hub and one or more impeller vanes projecting from the impeller hub, each of the one or more impeller vanes including an impeller vane edge, at least one stationary diffuser positioned below the at least one rotating impeller, the diffuser including a diffuser hub and a diffuser shroud comprising a diffuser shroud surface, where the impeller vane edge and the diffuser shroud surface are separated only by a clearance gap.

The clearance gap may range from about 0.005 inches to about 0.03 inches.

The clearance gap may be calculated as a function of a length of the impeller hub, a position of the diffuser shroud surface, an angle of the diffuser shroud, and a position of the impeller vane edge.

The clearance gap may be calculated as $d=(h1-(d1+v1))\times\cos(a)$, wherein h1 is the impeller hub length, d1 is the position of the diffuser shroud surface, a is the angle of the diffuser shroud, and v1 is the position of the impeller vane edge.

The clearance gap may be smaller than a boundary layer formed at the diffuser shroud surface.

The at least one stationary diffuser may be shaped to provide a mixed axial and radial flow pumping system for reducing flow resistance of high viscosity fluid.

The at least one rotating impeller and the at least one stationary diffuser together may include at most three boundary layers.

The three boundary layers may include an inner layer of the impeller hub, an outer layer of the impeller hub, and an outer layer of the at least one stationary diffuser.

The ESP may further include an up-thrust washer positioned above the impeller and a down-thrust washer positioned between the at least one rotating impeller and the at least one stationary diffuser.

The ESP may further include an up-thrust washer positioned above the at least one rotating impeller and a pair of hard alloy bearings positioned between the at least one rotating impeller and the at least one stationary diffuser.

The at least one rotating impeller may include a plurality of impellers, and the at least one stationary diffuser may include a plurality of diffusers, each impeller-diffuser pair providing a pumping stage to provide a plurality of pumping stages.

The ESP may further include a pump intake configured to suction production fluid into the ESP and a pump discharge configured to expel production fluid from the electrical submersible pump.

The at least one rotating impeller may include two rotating impellers and the at least one stationary diffuser may include two stationary diffusers, and one of the two rotating impellers may be attached to the two stationary diffusers and the pump shaft, and may be spaced apart from the other of the two rotating impellers by one of the two stationary diffusers so that axial movement of the one rotating impeller does not affect the other rotating impeller.

In another aspect, an electrical submersible pump (ESP) for use in a high viscosity pumping system includes at least two impellers, each including an impeller hub and one or more impeller vanes projecting from the impeller hub, each of the one or more impeller vanes including an impeller vane edge, at least two diffusers positioned above and below one of the at least two impellers, each of the at least two diffusers including a diffuser hub and a diffuser shroud including a diffuser shroud surface, where the at least two impellers are open impellers, and each of the impeller vane edges of the at least two impellers are separated from each of the diffuser shroud surfaces of the at least two diffusers only by a clearance gap.

The clearance gap may range from about 0.005 inches to about 0.03 inches.

A pair of impellers of the plurality of impellers may be separated from each other by one or more of one of the diffusers of the plurality of diffusers, a bearing, and a spacer, without being directly in contact or separated by a spring or biasing means.

Each clearance gap may be calculated as a function of a length of one of the impeller hubs, a position of one of the diffuser shroud surfaces, an angle of one of the diffuser shrouds, and a position of one of the impeller vane edges.

Each clearance gap may be calculated as $d=(h1-(d1+v1))\times\cos(a)$, where h1 is the length of the one of the impeller hubs, d1 is the position of the one of the diffuser shroud surfaces, a is the angle of the one of the diffuser shrouds, and v1 is the position of the one of the impeller vane edges.

The clearance gap may be smaller than a boundary layer formed at each of the diffuser shroud surfaces.

One of the plurality of impellers and one of the plurality of diffusers together may include at most three boundary layers.

The three boundary layers may be an inner layer of one of the impeller hubs, an outer layer of one of the impeller hubs, and an outer layer of one of the plurality of diffusers.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the invention is not limited to the precise arrangements and instrumentalities shown. The accompanying drawings, which are incorporated in and constitute a part of this specification, illustrate an implementation of system, apparatuses, and methods consistent with the present description and, together with the description, serve to explain advantages and principles consistent with the invention.

Further features, details and advantages of the invention are explained in the appended claims, in the drawings and in the description of a preferred embodiment of the head section according to the invention given below.

Figure 1:
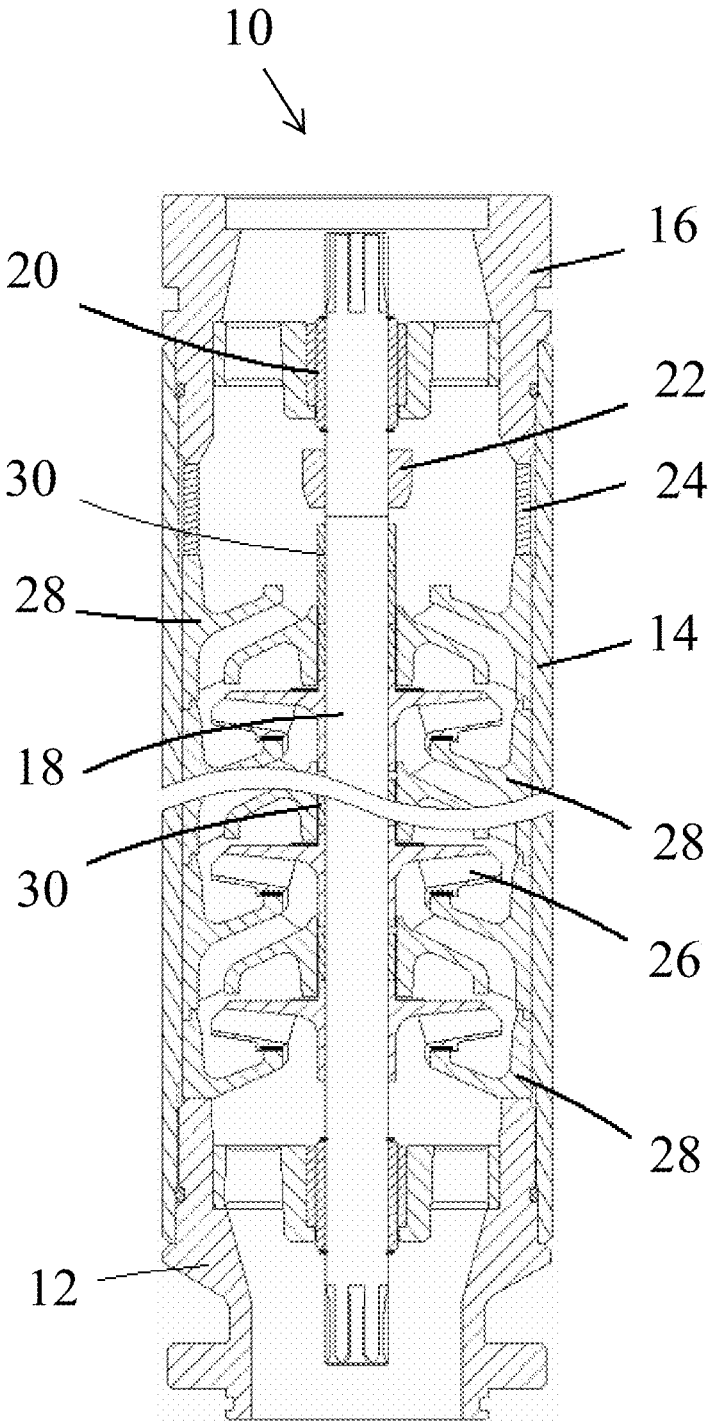
PRIOR ART FIGURE 1
FIG. 1 is a diagram illustrating a prior art ESP system.
Figure 2A:
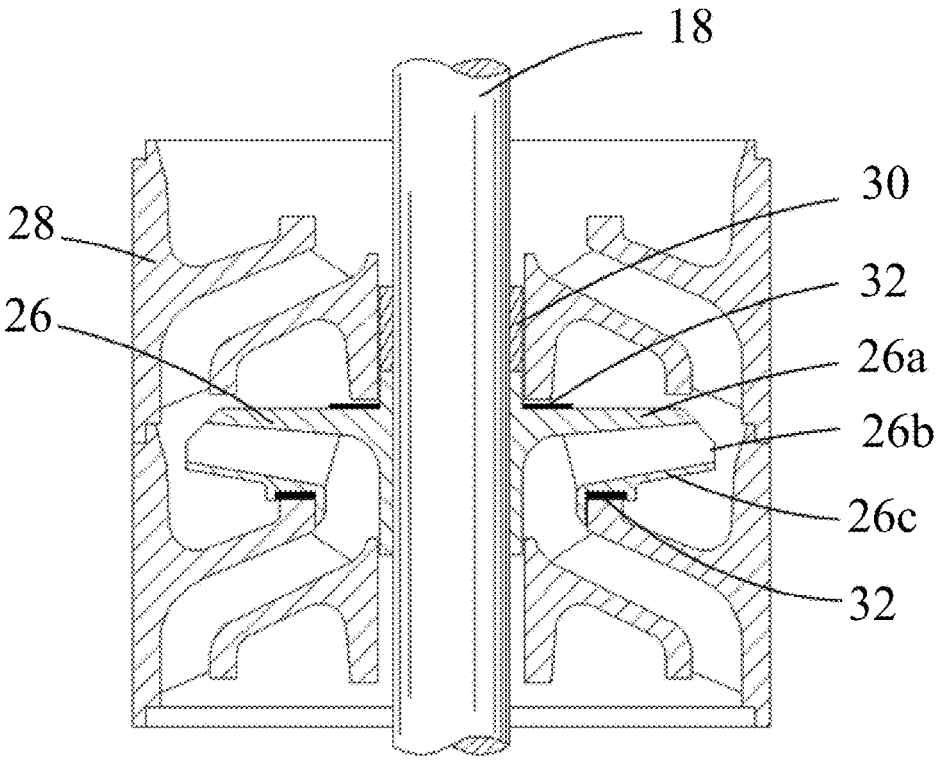
PRIOR ART FIGURE 2A
FIG. 2A is a diagram illustrating a close up view of a pumping stage of the prior art ESP system of FIG. 1A.
Figure 2B:
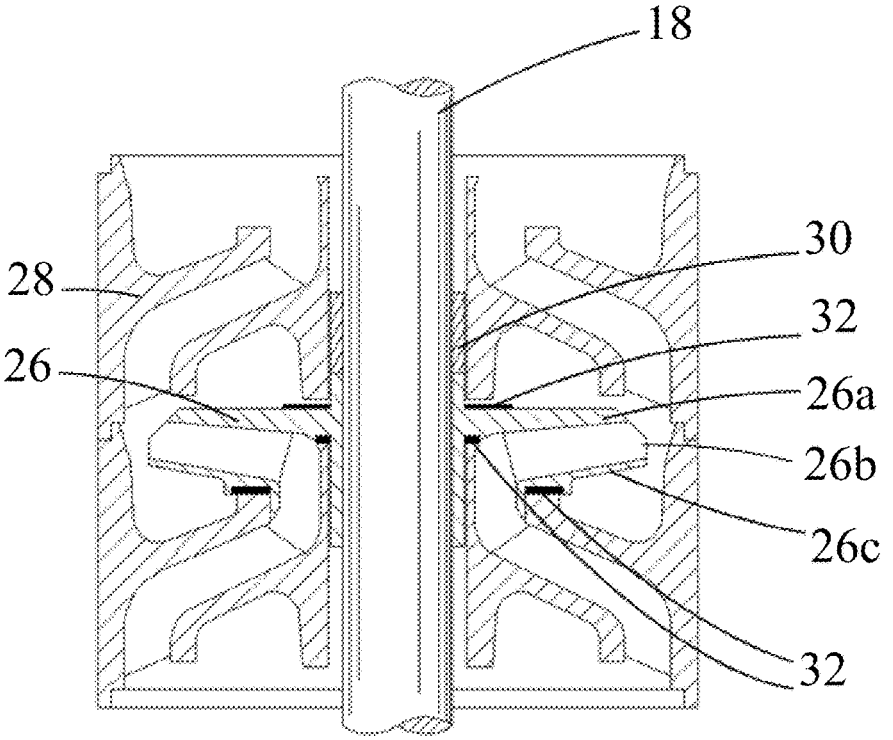
PRIOR ART FIGURE 2B
FIG. 2B is a diagram illustrating a close up view of a pumping stage of another prior art ESP system.
Figure 3A:
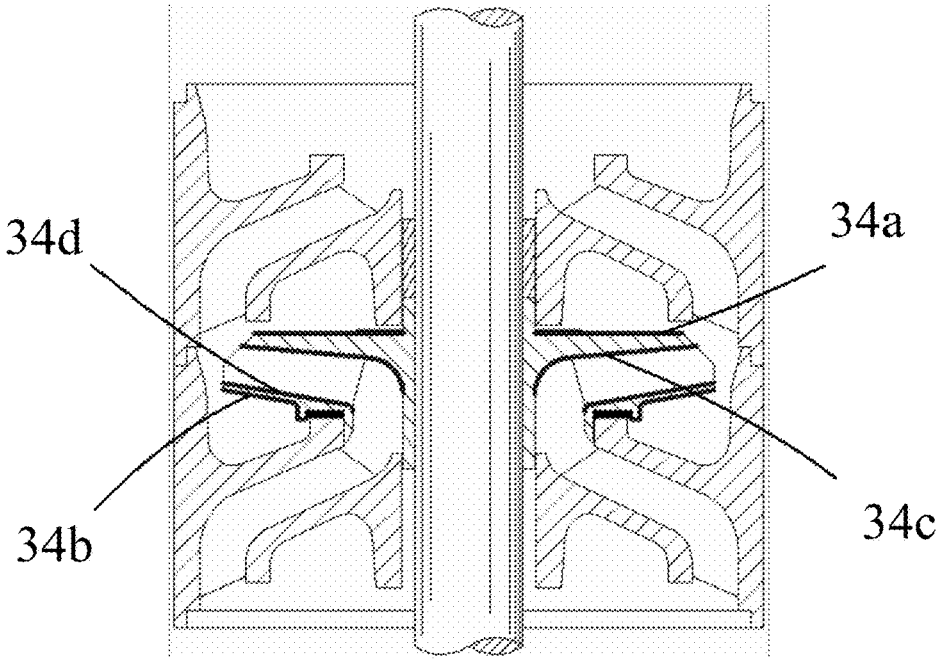
PRIOR ART FIGURE 3A
FIG. 3A is a diagram illustrating boundary layers of the pumping stage of the prior art ESP system of FIG. 2A.
Figure 3B:
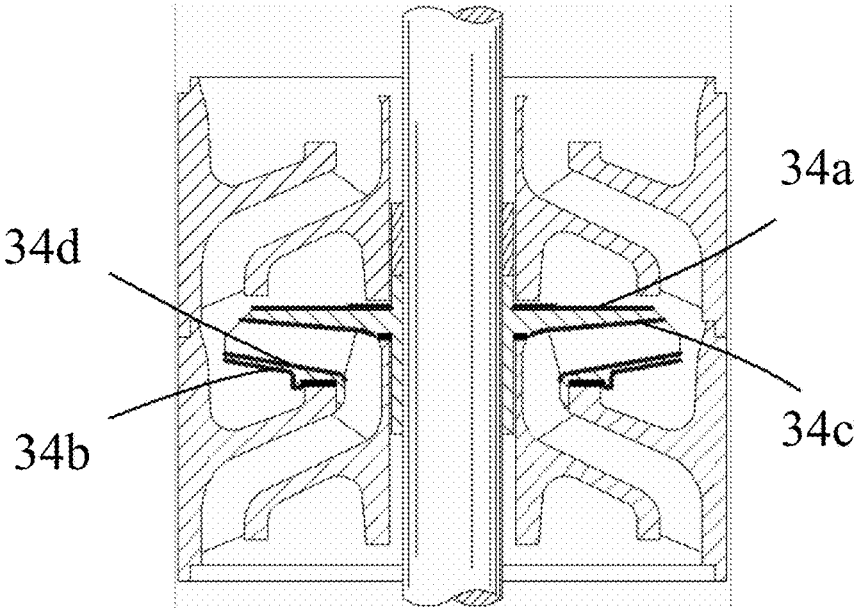
PRIOR ART FIGURE 3B
FIG. 3B is a diagram illustrating boundary layers of the pumping stage of the prior art ESP system of FIG. 2B.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Before explaining at least one embodiment of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiments incorporating aspects of the present inventions will require numerous implementation specific decisions to achieve the inventors' ultimate goal for the commercial embodiment. While these efforts can be time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

Figure 4:
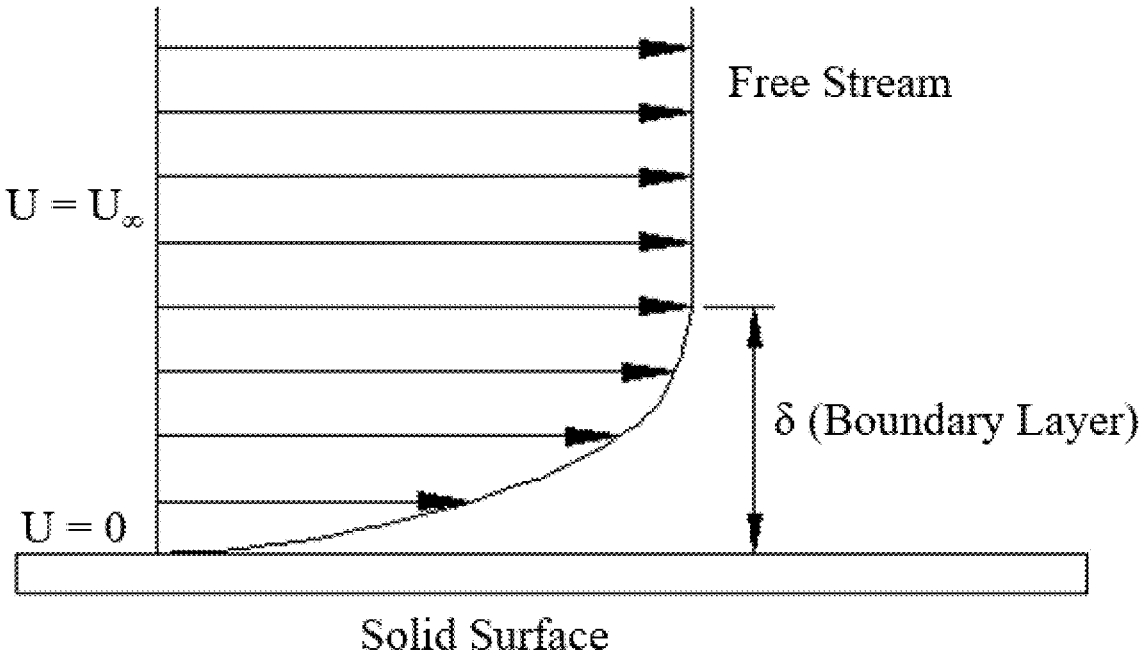
FIG. 4 is a diagram illustrating flow vectors for a pumping stage near a boundary layer.

FIG. 1 is a diagram illustrating a prior art ESP system. FIGS. 2A, 2B, 3A, and 3B are diagrams illustrating close up views and boundary layers of pumping stages of prior art ESP systems. FIG. 4 is a diagram illustrating flow vectors of pumping stages near a boundary layer. FIGS. 1-4 were previously discussed above in reference to conventional devices.

Figure 5:
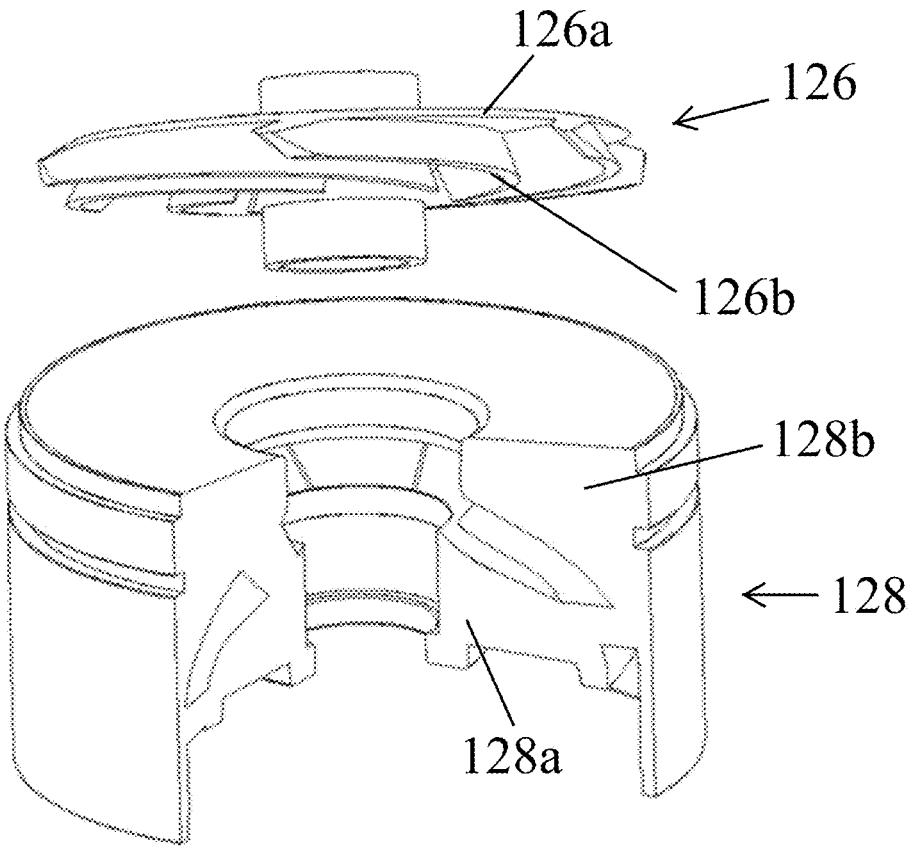
FIG. 5 is a diagram illustrating a perspective view of an example of an ESP system with an open impeller system.

FIG. 5 is a diagram illustrating a perspective view of an example of a stage of an ESP system with an open impeller system. Referring to FIG. 5, one stage of an ESP open impeller system is illustrated. In this example, a diffuser 128 may include a diffuser hub 128*a* and a diffuser shroud 128*b*, and an open impeller 126 may be constructed of two functional components, an impeller hub 126*a* and an impeller vane 126*b*. Each of these components are described in more detail below as provided in the following descriptions and examples.

Figure 6:
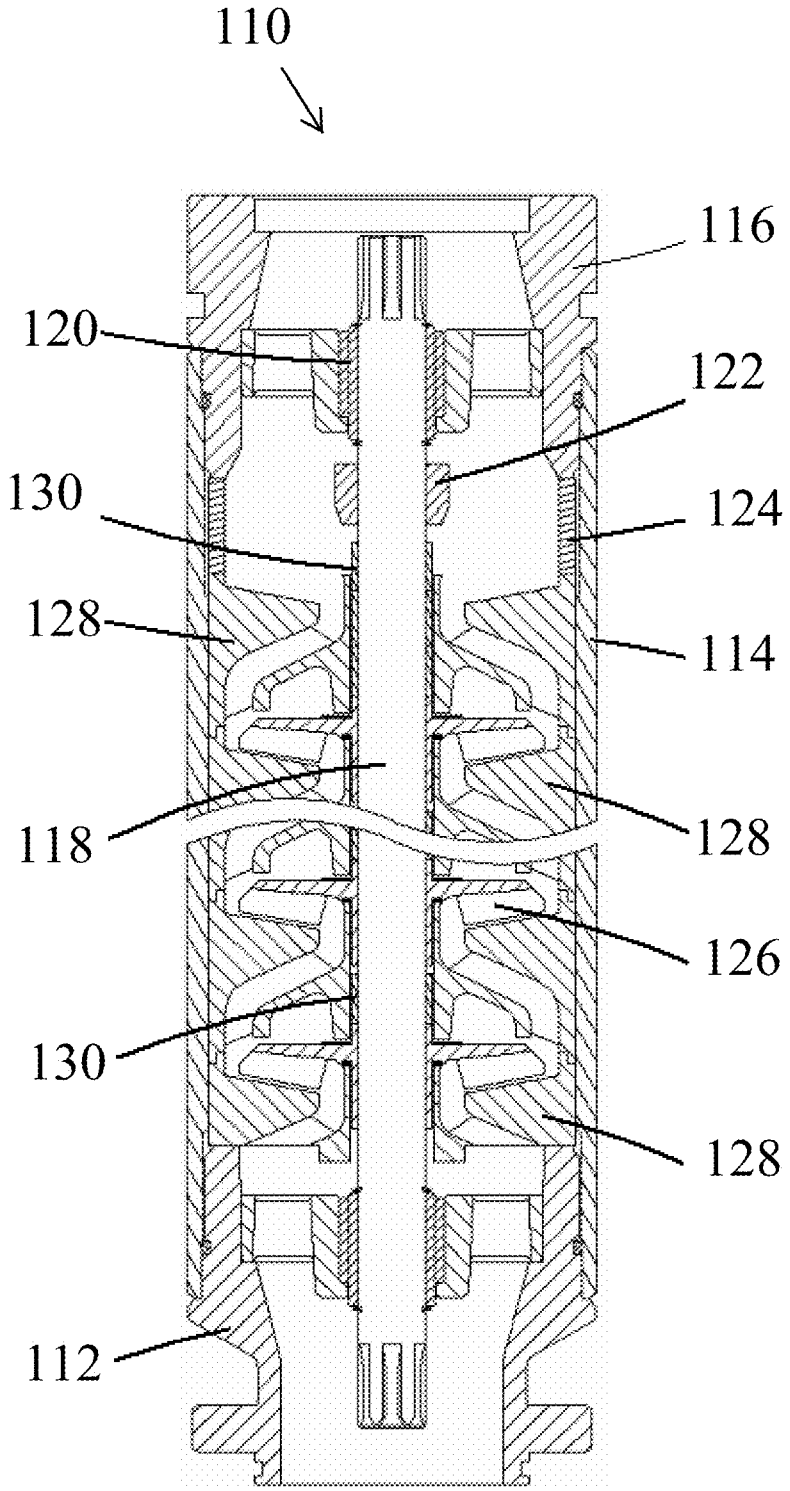
FIG. 6 is a diagram illustrating an example of an ESP system with an open impeller system.

FIG. 6 is a diagram illustrating an example of an ESP system 110 with an open impeller system.

Referring to FIG. 6, an Electrical Submersible Pump (ESP) 110 is illustrated. The ESP 110 includes a pump base 112, a housing 114, a pump discharge head 116, and a shaft 118. The pump base 112 is at the lower end of the pump assembly 110, and the discharge head 116 is at the upper end of the pump assembly 110. The production flow comes from the base 112 at the lower end and is expelled through the discharge head 116 at the upper end. In between the base 112 and the discharge head 116, a number of pumping stages are typically installed along the shaft 118; the number of pumping stages are illustrated only as an example. The breaking line in FIG. 6 is used to illustrate that any number of pumping stages may be used.

The pump base 112 may also works as an inlet hole of the pump. The pump will receive the production fluid through it. The base 112 can be attached to the housing 114 with one or more threaded connections. The other side of the base 112 may have a flange connection and holes for connection bolts. The pump may be connected to the other necessary units for operation, i.e. bolt on pump base 112, motor protector, or motor. One or more journal bearings 120 may be mounted at the base 112 to help the pump shaft 118 to rotate stably.

The pump discharge head 116 may be at the other end of ESP system 110, and may also work as an outlet hole of the pump. The pump may discharge the production fluid through it. The discharge head 116 may be attached to the housing 114 with one or more threaded connections. The other side of the head 116 may include a flange connection and holes for connection bolts. The pump can be connected to the other necessary units for operation, i.e. bolt on discharge head 116, or production tubing. One or more journal bearings 120 may be mounted at the pump head 116 to help the pump shaft 118 to rotate stably.

In this example, the housing 114 acts as a structural component holding all pump stages together. The housing 114 may also be enveloped by the head 116 and the base 112 at both ends. The housing 114 may have the shape of a metallic pipe with threaded connections at its ends. In this example, a key stop 112 and a compression tube 124 are other components of the pump assembly 110.

The pumping stages of the ESP 110 include an open impeller 126 and a diffuser 128. An open impeller 126, as described throughout this application, is an impeller 126 which does not include an impeller shroud 26*c*, unlike the conventional impeller 26. A spacer 130 may be positioned between the diffuser 128 and the pump shaft 118. Each impeller 126 may be located between two diffusers 128. The Impellers 126 rotate with the pump shaft 118 which is connected to a motor (not shown). Each impeller 126 may be separated from other impellers 126 by a diffuser 128 so that no two impellers 126 are directly attached to one another, and are separated from one another by at least one diffuser 128 and/or a spacer 130. As a result, axial movement of one rotating impeller 126 would not significantly affect movement of the other rotating impeller 126.

Figure 7A:
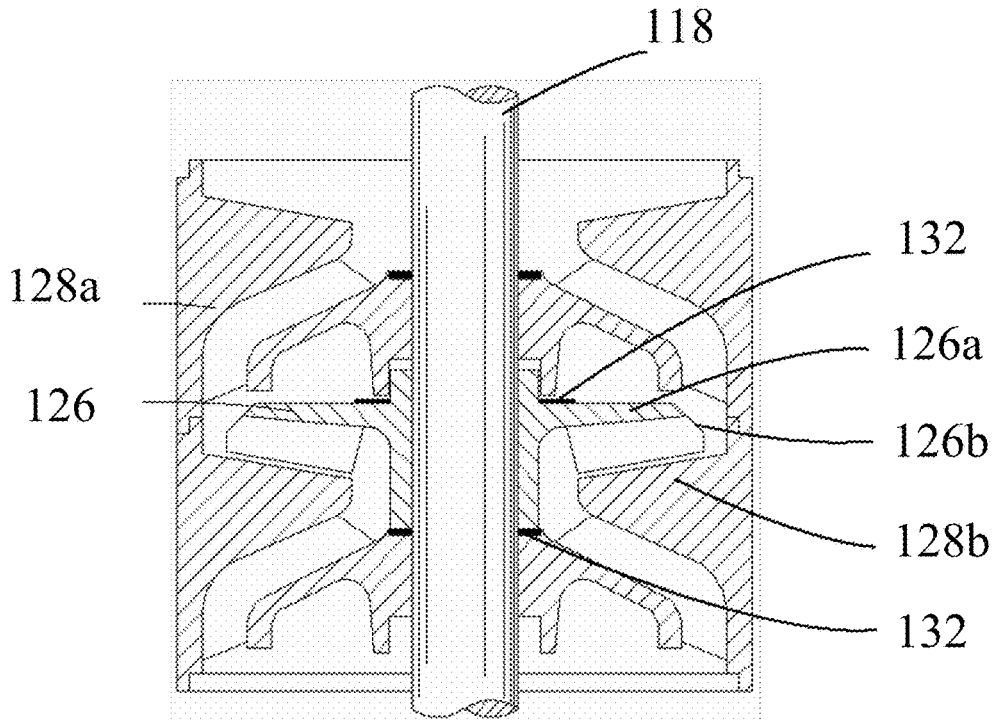
FIG. 7A is a diagram illustrating a close up view of a pumping stage of the ESP system of FIG. 6.
Figure 7B:
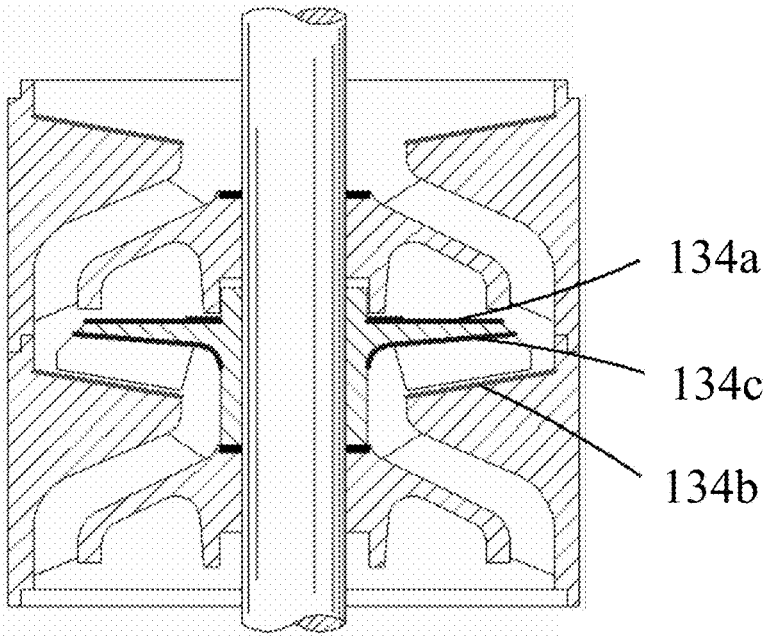
FIG. 7B is a diagram illustrating boundary layers of the pumping stage of the ESP system of FIG. 7A.

FIG. 7A is a diagram illustrating a close up view of a pumping stage of the ESP system 110 of FIG. 6, and FIG. 7B is a diagram illustrating boundary layers 134*a*, 134*b*, 134*c* of the pumping stage of the ESP system 110 of FIG. 7A.

Referring to FIG. 7A, the diffuser 128 may include a diffuser hub 128*a* and a diffuser shroud 128*b*, and the open impeller 126 may be constructed of two functional components, the impeller hub 126*a* and the impeller vane 126*b*. Without a shroud, the leakage and overflow between the impeller vane 126*b* and the surface of the diffuser shroud 128*b* might generate another loss of power. Instead of an impeller shroud, an upper surface of the diffuser 128 may be extended to the tip of the impeller vane 126*b* to act as a cover and prevent the flow over the impeller vanes 126*b*. Proper control of the clearance gap between the diffuser 128 and the impeller 126 may minimize the leakage loss by overflow with minimal loss of energy. A detailed description of calculating the clearance gap is provided in more detail below and in reference to FIG. 10.

In this example, an up thrust washer 132 is positioned on an upper surface of the impeller hub 126*a* and under a lower surface of the diffuser hub 128*a*, and a down thrust washer 132 is positioned under the impeller hub 126*a* and above an upper surface of the diffuser hub 128*a*. The impeller hub 126*a* includes a neck which extends down towards the diffuser hub 128*a* and beyond a length of the impeller vanes 128*b* so that the neck of the impeller 126*a* is adjacent to the clearance gap.

Referring to FIG. 7B, the use of an open impeller 126 reduces the number of boundary layers and reduces the energy loss and flow reduction of the system ordinarily resulting from such boundary layers. In this example, the boundary layers include a layer 134*a* at the top of the impeller 126, a layer 134*b* at the surface of the diffuser shroud 128*b*, and a layer 134*c* at the inner flow surface of the impeller 126.

Figure 8A:
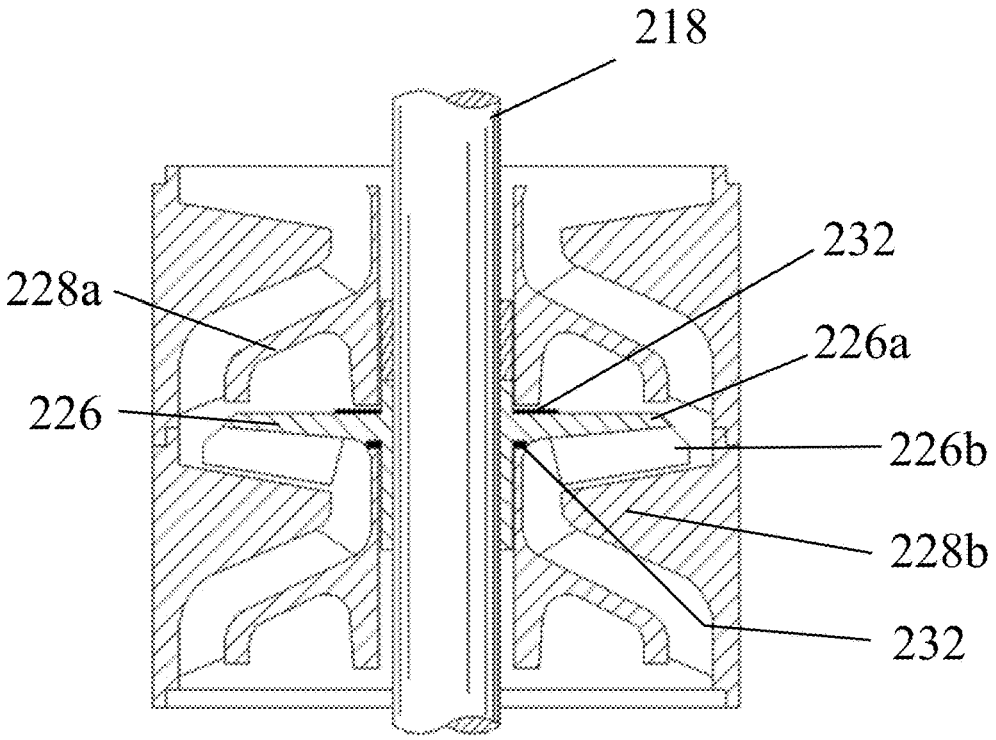
FIG. 8A is a diagram illustrating a close up view of a pumping stage of another example of an ESP system.
Figure 8B:
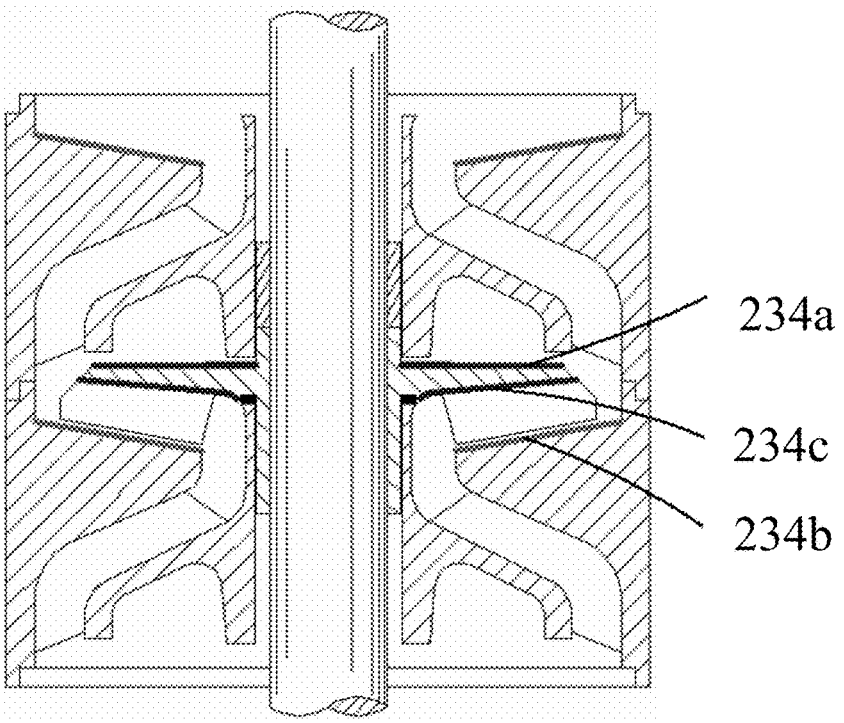
FIG. 8B is a diagram illustrating boundary layers of the pumping stage of the ESP system of FIG. 8A.

FIG. 8A is a diagram illustrating a close up view of a pumping stage of another example of an ESP system. FIG. 8B is a diagram illustrating boundary layers 234*a*, 234*b*, 234*c* of the pumping stage of the ESP system of FIG. 8A.

Referring to FIG. 8A, the diffuser 228 may include a diffuser hub 228*a* and a diffuser shroud 228*b*, and the open impeller 226 may be constructed of two functional components, the impeller hub 226*a* and the impeller vane 226*b*. In this example, an up thrust washer 232 is positioned on an upper surface of the impeller hub 226*a* and under a lower surface of the diffuser hub 228*a*, and a down thrust washer 232 is positioned under a surface of the impeller hub 226*a* and above an upper surface of the diffuser hub 228*a*. The impeller hub 226*a* includes a neck which extends down towards the diffuser hub 228*a* beyond a length of the impeller vanes 228*b*. The diffuser hub 228*a* also includes a neck which extends up towards the impeller hub 226*a* and overlaps the neck of the impeller hub 226*a* so that overlapping necks are adjacent to the clearance gap. In this example, the down thrust washer 232 is positioned at the contact point above the neck of the diffuser hub 228*a*.

Referring to FIG. 8B, similar to FIG. 7B, the use of an open impeller 226 reduces the number of boundary layers and reduces the energy loss and flow reduction of the system ordinarily resulting from such boundary layers. In this example, the boundary layers include a layer 234*a* at the top of the impeller 226, a layer 234*b* at the surface of the diffuser shroud 228*b*, and a layer 234*c* at the inner flow surface of the impeller 226.

Figure 9A:
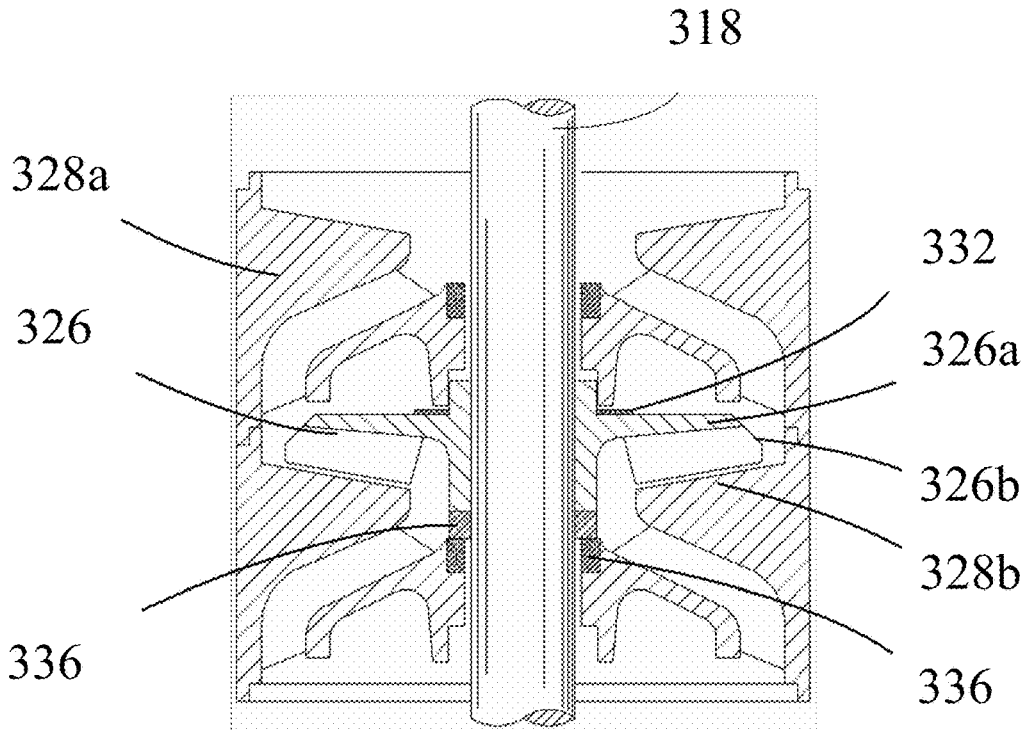
FIG. 9A is a diagram illustrating a close up view of a pumping stage of yet another example of an ESP system.
Figure 9B:
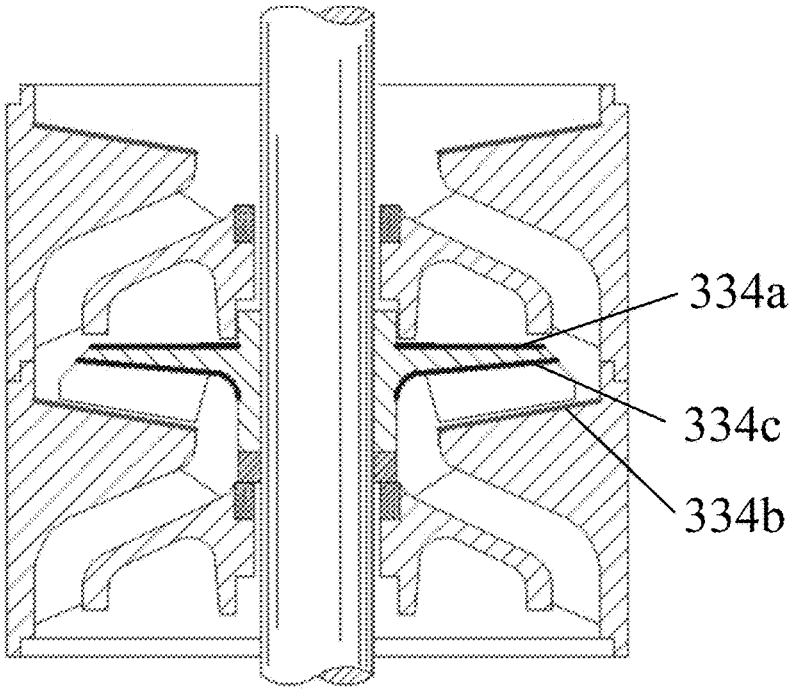
FIG. 9B is a diagram illustrating boundary layers of the pumping stage of the ESP system of FIG. 9A.

FIG. 9A is a diagram illustrating a close up view of a pumping stage of yet another example of an ESP system. FIG. 9B is a diagram illustrating boundary layers 334*a*, 334*b*, 334*c* of the pumping stage of the ESP system of FIG. 9A.

Referring to FIG. 9A, the diffuser 328 may include a diffuser hub 328*a* and a diffuser shroud 328*b*, and the open impeller 326 may be constructed of two functional components, the impeller hub 326*a* and the impeller vane 326*b*. In this example, an up thrust washer 332 is positioned on an upper surface of the impeller hub 326*a* and under a lower surface of the diffuser hub 328*a*, and a pair of hard alloy bearings 336 are positioned between a lower surface of the impeller hub 326*a* and an upper surface of the diffuser hub 328*a*. In this example, the diffuser hub 328*a* receives at least one of the hard alloy bearings 336. The impeller hub 326*a* includes a neck which extends down towards the diffuser hub 328*a* beyond a length of the impeller vanes 328*b* so that the neck of the impeller 326*a* is adjacent to the clearance gap.

Referring to FIG. 9B, similar to FIGS. 7B and 8B, the use of an open impeller 326 reduces the number of boundary layers and reduces the energy loss and flow reduction of the system ordinarily resulting from such boundary layers. In this example, the boundary layers include a layer 334*a* at the top of the impeller 326, a layer 334*b* at the surface of the diffuser shroud 328*b*, and a layer 334*c* at the inner flow surface of the impeller 326.

Figure 10:
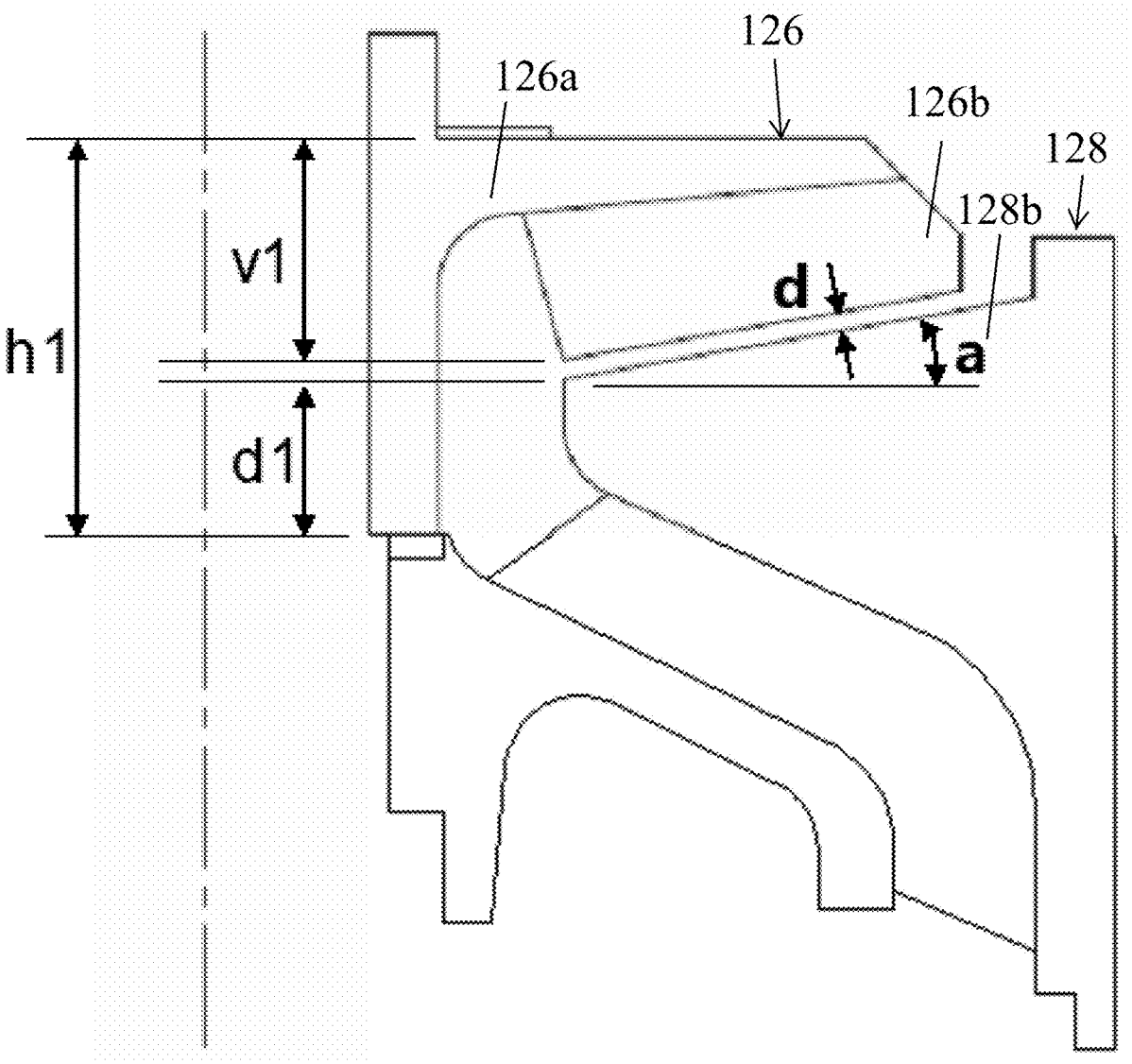
FIG. 10 is a diagram illustrating an example of a clearance gap between an impeller and a diffuser.
Figure 11:
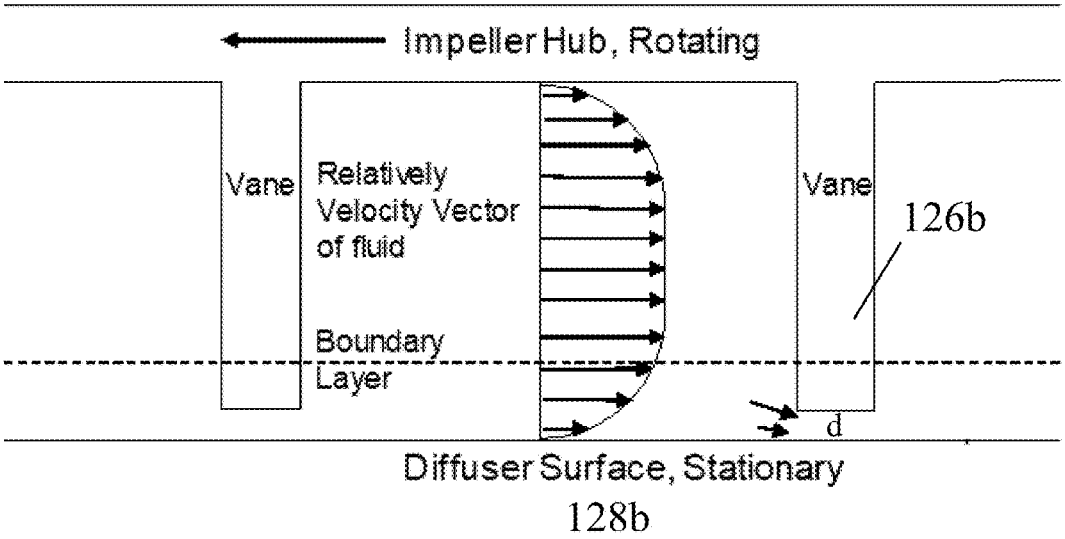
FIG. 11 is a diagram illustrating an example of flow vectors for the pumping stages of the example ESP systems described throughout near a boundary layer.

FIG. 10 is a diagram illustrating an example of a clearance gap d between an impeller 126 and a diffuser 128. FIG. 11 is a diagram illustrating an example of flow vectors for the pumping stages of the example ESP systems described throughout near a boundary layer.

Referring to FIGS. 10 and 11, proper control of the clearance gap d between the impeller 126 and the diffuser 128 can minimize the leakage loss by overflow with minimal loss of energy. Controlling the clearance gap d between impeller vane 126*b* and the surface of the diffuser shroud 128*b* helps to achieve the optimal power consumption. If the gap d is too large, too much overflow at the vane 126*b* tip will increase the pressure loss. If the gap d is too small, the drag force will increase the power consumption.

In a preferred example, the clearance gap d between the impeller vane 126*b* and the surface of the diffuser shroud 128*b* is less than the thickness of a boundary layer at the diffuser surface, as illustrated in FIG. 11. The boundary layer is a layer of fluid in the immediate vicinity of a bounding surface where the effects of viscosity are significant; in this example, the boundary layer is the layer near the surface of the diffuser shroud 128*b*. By adjusting the clearance gap d, to be narrower than the boundary layer, minimal spill is achieved. In a preferred example, the clearance gap d measures approximately 0.015 inches; however, it should be appreciated that any clearance gap d measurement may be used and the measurement may vary.

The clearance gap may be adjusted by adjusting a position of the diffuser hub 128*b* and the length of the impeller hub. Referring to FIG. 10, the clearance gap d may be calculated as follows:

Impeller hub length: h1

Diffuser surface tip position: d1

Diffuser shroud angle: a

Impeller vane tip position: v1

Clearance gap: $d=(h1-(d1+v1))\times\cos(a)$

Referring to FIG. 10, the length h1 of the impeller hub 126*a* is measured from the upper planar surface carrying the impeller vanes 126*b* to the bottom surface of the impeller hub 126*a*. The tip position d1 of the surface of the diffuser shroud 128*b* is measured from the innermost edge of the surface of the diffuser shroud 128*b* to the bottom surface of the impeller hub 126*a*. The shroud angle a is the angle between the surface of the diffuser shroud 128*b* and the horizontal axis. The tip position v1 of the impeller vane 126*b* is measured from the innermost edge of the surface of the impeller vane 126*b* to the upper planar surface carrying the impeller vanes 126*b*. Using these measurements, the clearance gap d may be calculated according to the equation above.

In a preferred example, the clearance gap d may range from about 0.03 inches to about 0.005 inches; more specifically, a gap measuring about 0.015 inches may be preferred. In one example, the measurement of the clearance gap d may vary depending on the viscosity of the fluid which is used with the ESP system 110. For example, a higher viscosity fluid may be expected to form a larger boundary layer; thus, for use with higher viscosity fluids. the clearance gap d can be larger. The gap d may measure at least 0.005 inches, at least 0.01 inches, at least 0.015 inches, at least 0.02 inches, at least 0.025 inches, at least 0.03 inches, at most 0.005 inches, at most 0.01 inches, at most 0.015 inches, at most 0.02 inches, at most 0.025 inches, or at most 0.03 inches, among other examples. In these examples, the impeller hub

126*a* acts as an upper cover of the impeller flow path. Multiple impeller vanes 126*b* are connected to the hub 126*a*, and vanes 126*b* work to guide the flow. The number of impeller vanes 126*b* may vary. In a preferred example, 5 to 10 vanes 126*b* are used per impeller 126 and equidistantly arranged in a circle of the impeller flow path. Through the space between the vanes 126*b*, fluid will be centrifugally energized and transferred from one stage to another stage.

The contact surfaces between the impeller 126 and the diffuser 128 may be covered with bearing pad material. For example, one option of the material for bearing pads is phenolic laminate. Ceramic material may also be used and may exhibit a longer lasting lifespan and increased durability.

Figure 12:
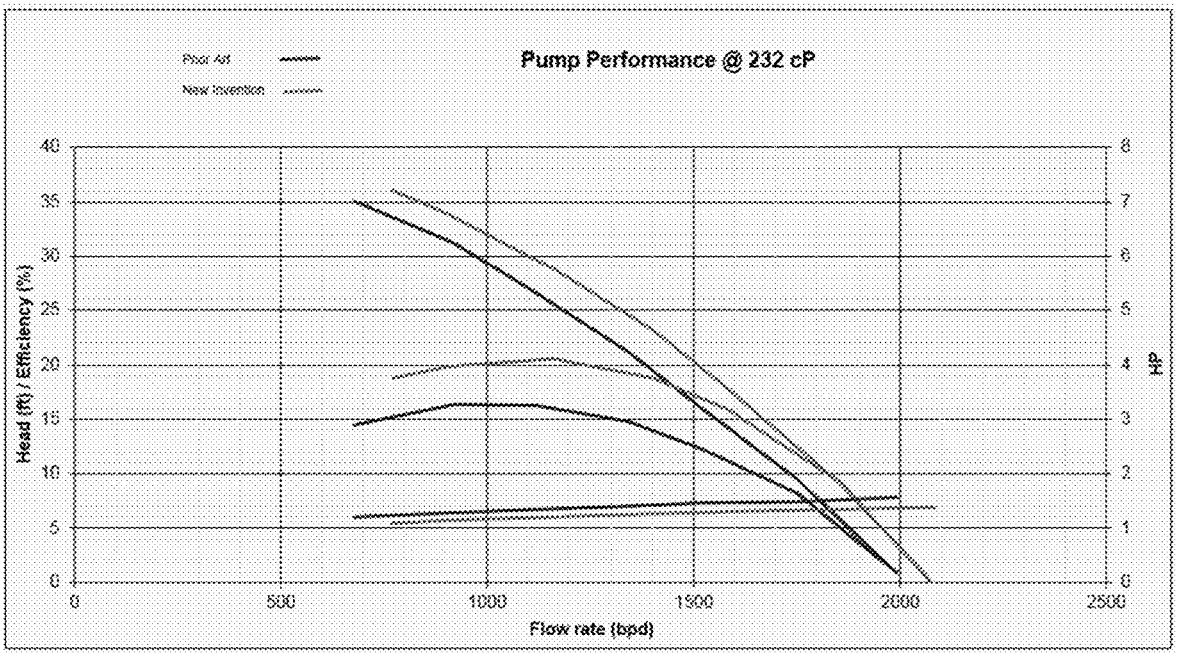
FIG. 12 is a diagram illustrating an example of pump performance for the example ESP systems described throughout compared to prior art ESP systems.

FIG. 12 is a diagram illustrating an example of pump performance for the example ESP systems described throughout compared to the prior art ESP systems. Based on the concepts described, a new pump was tested with viscous fluid using the pump stages of this application. The test result of the new pump was compared to the performance of the prior art pump. The result illustrates that the performance of the new pump was superior to the performance of the prior art pump. That is, the new pump has a lower power consumption, a higher discharge head, and better efficiency than the prior art pump.

In an example, the open-impeller ESP systems 110 of this application, including the examples of FIGS. 7A-9B, are used for fluids with high viscosity. Accordingly, the diffuser is shaped to provide a mixed-flow system, i.e. a mix of radial and axial flow, which is better for high viscosity fluids because less flow resistance is created by boundary layers. In addition, for use with high viscous fluid, the ESP systems exhibits reduced, if not negligible, upward thrust. As a result, no biasing means or wave springs need to be used in the system to counteract up-thrust, and especially not between impellers. This reduces the number of components in the system and provides a simpler construction which requires less maintenance and upkeep.

Further, in a preferred example, each impeller of the stages of the ESP systems 110 is structurally separated from the impeller of the adjacent pump stages. That is, each impeller is attached to the shaft and spaced apart from the adjacent impellers so that no portion of the impeller is directly in contact with a portion of another impeller or separated only by a biasing means.

One of skill in the art will recognize that the embodiments described above are not limited to any particular size and the size of the pump and other pump system components will depend upon the particular application and intended components. It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. An electrical submersible pump (ESP) for use in a pumping system, the ESP comprising:

a pump shaft;

at least one rotating impeller comprising an impeller hub and one or more impeller vanes projecting from the impeller hub, each of the one or more impeller vanes comprising an impeller vane edge; and at least one stationary diffuser positioned upstream the at least one rotating impeller, the diffuser comprising a diffuser hub and a diffuser shroud comprising a diffuser shroud surface, wherein the impeller vane edge and the diffuser shroud surface are separated only by a clearance gap, and wherein the clearance gap is calculated as a function of the impeller hub, a position of the diffuser shroud surface, an angle of the diffuser shroud, and a position of the impeller vane edge.

2. The ESP of claim 1, wherein the clearance gap ranges from 0.005 inches to 0.03 inches.

3. The ESP of claim 1, wherein the clearance gap is calculated as $d=(h1-(d1+v1))\times\cos(a)$, wherein h1 is the impeller hub length, d1 is the position of the diffuser shroud surface, a is the angle of the diffuser shroud, and v1 is the position of the impeller vane edge.

4. The ESP of claim 1, wherein the clearance gap is smaller than a boundary layer formed at the diffuser shroud surface.

5. The ESP of claim 1, wherein the at least one stationary diffuser is shaped to provide a mixed axial and radial flow pumping system for reducing flow resistance of fluid.

6. The ESP of claim 1, wherein the at least one rotating impeller and the at least one stationary diffuser together include at most three boundary layers.

7. The ESP of claim 6, wherein the at most three boundary layers comprise at most opposing layers of the impeller hub and a layer of the at least one stationary diffuser.

8. The ESP of claim 1, further comprising an up-thrust washer positioned above the impeller and a down-thrust washer positioned between the at least one rotating impeller and the at least one stationary diffuser.

9. The ESP of claim 1, further comprising an up-thrust washer positioned above the at least one rotating impeller and a pair of hard alloy bearings positioned between the at least one rotating impeller and the at least one stationary diffuser.

10. The ESP of claim 1, wherein the at least one rotating impeller comprises a plurality of impellers, and the at least one stationary diffuser comprises a plurality of diffusers, each impeller-diffuser pair providing a pumping stage to provide a plurality of pumping stages.

11. The ESP of claim 1, further comprising a pump intake configured to suction production fluid into the ESP and a pump discharge configured to expel production fluid from the electrical submersible pump.

12. The ESP of claim 1, wherein the at least one rotating impeller comprises two rotating impellers and the at least one stationary diffuser comprises two stationary diffusers, and one of the two rotating impellers is between the two stationary diffusers and attached to the pump shaft, and is spaced apart from the other of the two rotating impellers by one of the two stationary diffusers so that axial movement of the one rotating impeller does not affect the other rotating impeller.

13. An electrical submersible pump (ESP) for use in a pumping system, the ESP comprising:

a plurality of impellers, each comprising an impeller hub and one or more impeller vanes projecting from the impeller hub, each of the one or more impeller vanes comprising an impeller vane edge; and a plurality of diffusers positioned upstream and downstream one of the plurality of impellers, each of the plurality of diffusers comprising a diffuser hub and a diffuser shroud comprising a diffuser shroud surface, wherein the plurality of impellers are open impellers, and each of the impeller vane edges of the plurality of impellers are separated from each of the diffuser shroud surfaces of the plurality of diffusers only by a clearance gap, and wherein each clearance gap is calculated as a function of a length of one of the impeller hubs, a position of one of the diffuser shroud surfaces, an angle of one of the diffuser shrouds, and a position of one of the impeller vane edges.

14. The ESP of claim 13, wherein the clearance gap ranges from 0.005 inches to 4-0.03 inches.

15. The ESP of claim 13, wherein a pair of impellers of the plurality of impellers are separated from each other by one or more of one of the diffusers of the plurality of diffusers, a bearing, and a spacer, without being directly in contact or separated by a spring or biasing means.

16. The ESP of claim 13, wherein each clearance gap is calculated as $d=(h1-(d1+v1))\times\cos(a)$, wherein h1 is the length of the one of the impeller hubs, d1 is the position of the one of the diffuser shroud surfaces, a is the angle of the one of the diffuser shrouds, and v1 is the position of the one of the impeller vane edges.

17. The ESP of claim 13, wherein the clearance gap is smaller than a boundary layer formed at each of the diffuser shroud surfaces.

18. The ESP of claim 13, wherein one of the plurality of impellers and one of the plurality of diffusers together include at most three boundary layers.

19. The ESP of claim 18, wherein the at most at three boundary layers comprise at most opposing layers of the impeller hubs and a layer of one of the plurality of diffusers.

* * * * *